US007788794B2

(12) United States Patent
Sarver et al.

(10) Patent No.: US 7,788,794 B2
(45) Date of Patent: Sep. 7, 2010

(54) DISC-WOUND TRANSFORMER WITH FOIL CONDUCTOR AND METHOD OF MANUFACTURING THE SAME

(75) Inventors: Charlie H. Sarver, Rocky Gap, VA (US); William E. Pauley, Jr., Bland, VA (US); Rush B. Horton, Jr., Wytheville, VA (US)

(73) Assignee: ABB Technology AG, Zurich (CH)

( * ) Notice: Subject to any disclaimer, the term of this patent is extended or adjusted under 35 U.S.C. 154(b) by 737 days.

(21) Appl. No.: 11/442,809

(22) Filed: May 30, 2006

(65) Prior Publication Data

US 2007/0279177 A1 Dec. 6, 2007

(51) Int. Cl.
*H01F 7/127* (2006.01)

(52) U.S. Cl. ..... 29/602.1; 29/605; 29/606; 336/206; 336/213; 336/220

(58) Field of Classification Search ..... 29/602.1, 29/605, 606, 868; 242/610.6; 336/186, 206, 336/213, 220
See application file for complete search history.

(56) References Cited

U.S. PATENT DOCUMENTS

| | | | | |
|---|---|---|---|---|
| 3,737,990 | A * | 6/1973 | Schut | 29/605 |
| 4,311,979 | A * | 1/1982 | Graul | 29/605 X |
| 4,321,426 | A * | 3/1982 | Schaeffer et al. | 336/186 X |
| 5,267,393 | A | 12/1993 | Purohit et al. | |
| 5,396,210 | A | 3/1995 | Purohit et al. | |
| 5,461,772 | A | 10/1995 | Puri | |
| 5,621,372 | A | 4/1997 | Purohit | |
| 5,798,678 | A | 8/1998 | Manlief et al. | |
| 6,160,464 | A | 12/2000 | Clarke et al. | |
| 6,221,297 | B1 | 4/2001 | Lanoue et al. | |
| 6,223,421 | B1 | 5/2001 | Lanoue et al. | |
| 6,642,830 | B1 | 11/2003 | Ball | |
| 6,806,803 | B2 | 10/2004 | Hopkinson et al. | |
| 6,930,582 | B2 | 8/2005 | Ball | |
| 2002/0130749 | A1 | 9/2002 | Hay | |

FOREIGN PATENT DOCUMENTS

| | | | | |
|---|---|---|---|---|
| DE | 19919066 | | 2/2000 | |
| JP | 57060824 | A * | 4/1982 | 29/602.1 |
| WO | PCT/US2007/012219 | | 12/2007 | |

OTHER PUBLICATIONS

Gunewardena et al, "High Voltage Miniature Transformer Design", Electrical Insulation Conference and Electrical Manufacturing and Coil Winding Conference, 2001 Proceedings, Oct 18, 2001, pp. 141-147.*

* cited by examiner

*Primary Examiner*—A. Dexter Tugbang
(74) *Attorney, Agent, or Firm*—Paul Katterle

(57) ABSTRACT

A transformer and a method of manufacturing the same are provided. The transformer includes a coil assembly mounted to a leg of a core. The coil assembly includes a low voltage coil and an insulation spool disposed over the low voltage coil. The insulation spool is composed of an insulating material and includes a plurality of guide strips defining a plurality of series of aligned notches. A high voltage coil is mounted to the insulation spool and includes a plurality of disc windings disposed in the series of aligned notches, respectively. Each of the disc windings comprises alternating concentric conductor layers and insulating layers. The conductor layers each have a width to thickness ratio of greater than 20:1.

16 Claims, 3 Drawing Sheets

DISC-WOUND TRANSFORMER WITH FOIL CONDUCTOR AND METHOD OF MANUFACTURING THE SAME

BACKGROUND OF THE INVENTION

This invention relates to transformers and more particularly to transformers with disc-wound coils.

As is well known, a transformer converts electricity at one voltage to electricity as another voltage, either of higher or lower value. A transformer achieves this voltage conversion using a primary coil and a secondary coil, each of which are wound on a ferromagnetic core and comprise a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load. Two main winding techniques are used to form coils, namely layer winding and disc winding. The type of winding technique that is utilized to form a coil is primarily determined by the number of turns in the coil and the current in the coil. For high voltage windings with a large number of required turns, the disc winding technique is typically used, whereas for low voltage windings with a smaller number of required turns, the layer winding technique is typically used.

In the layer winding technique, the conductor turns required for a coil are typically wound in one or more concentric conductor layers connected in series, with the turns of each conductor layer being wound side by side along the axial length of the coil until the conductor layer is full. A layer of insulation material is disposed between each pair of conductor layers.

A different type of layer winding technique is disclosed in U.S. Pat. No. 6,221,297 to Lanoue et al., which is assigned to the assignee of the present application, ABB Inc., and which is hereby incorporated by reference. In the Lanoue et al. '297 patent, alternating sheet conductor layers and sheet insulating layers are continuously wound around a base of a winding mandrel. The winding technique of the Lanoue et al. '297 patent can be performed using an automated dispensing machine 64, which facilitates the production of a layer-wound coil.

In the disc winding technique, the conductor turns required for a coil are wound in a plurality of discs serially disposed along the axial length of the coil. In each disc, the turns are wound in a radial direction, one on top of the other, i.e., one turn per layer. The discs are connected in a series circuit relation and are typically wound alternately from inside to outside and from outside to inside so that the discs can be formed from the same conductor. The conductor used to form a disc winding is typically in the form of a wire with a rectangular or a rounded rectangular cross-section. Such a conductor is typically difficult to wind.

It would therefore be desirable to provide a transformer with a disc-wound coil that is easier to manufacture. The present invention is directed to such a transformer and a method for manufacturing such a transformer.

SUMMARY OF THE INVENTION

In accordance with the present invention, a method of manufacturing a transformer is provided, wherein a core and a low voltage core are provided. A disc-wound high voltage coil is formed by providing a winding mandrel, an insulation strip and a conductor strip having a width to thickness ratio of greater than 20:1. The insulation strip and the conductor strip are wound around the winding mandrel to form a plurality of disc windings arranged in an axial direction of the high voltage coil, wherein each of the disc windings is formed from alternating concentric conductor layers and insulating layers. The low voltage and the high voltage coils are mounted to the core.

Also provided in accordance with the present invention is a method for manufacturing a transformer, wherein a low voltage coil and a core with a leg are provided. A disc-wound high voltage coil is formed by providing an insulation strip, a conductor strip and an insulation spool comprised of an insulating material. The conductor strip has a width to thickness ratio of greater than 20:1. The insulation strip and the conductor strip are wound around the insulation spool so as to form a plurality of disc windings arranged in an axial direction of the high voltage coil. Each of the disc windings includes alternating concentric conductor layers and insulating layers. The low voltage coil is mounted to the core and the high voltage coil is mounted to the core such that the leg extends through the insulation spool.

A transformer is also provided in accordance with the present invention. The transformer includes a core with a leg and a coil assembly mounted to the leg of the core. The coil assembly includes a high voltage coil, a low voltage coil and an insulation spool disposed over the low voltage coil. The insulation spool includes an insulating material and defines a first series of aligned notches and a second series of aligned notches. The high voltage coil includes a first disc winding disposed in the first series of aligned notches and a second disc winding disposed in the second series of aligned notches. Each of the first and second disc windings includes alternating concentric conductor layers and insulating layers. The conductor layers each have a width to thickness ratio of greater than 20:1.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
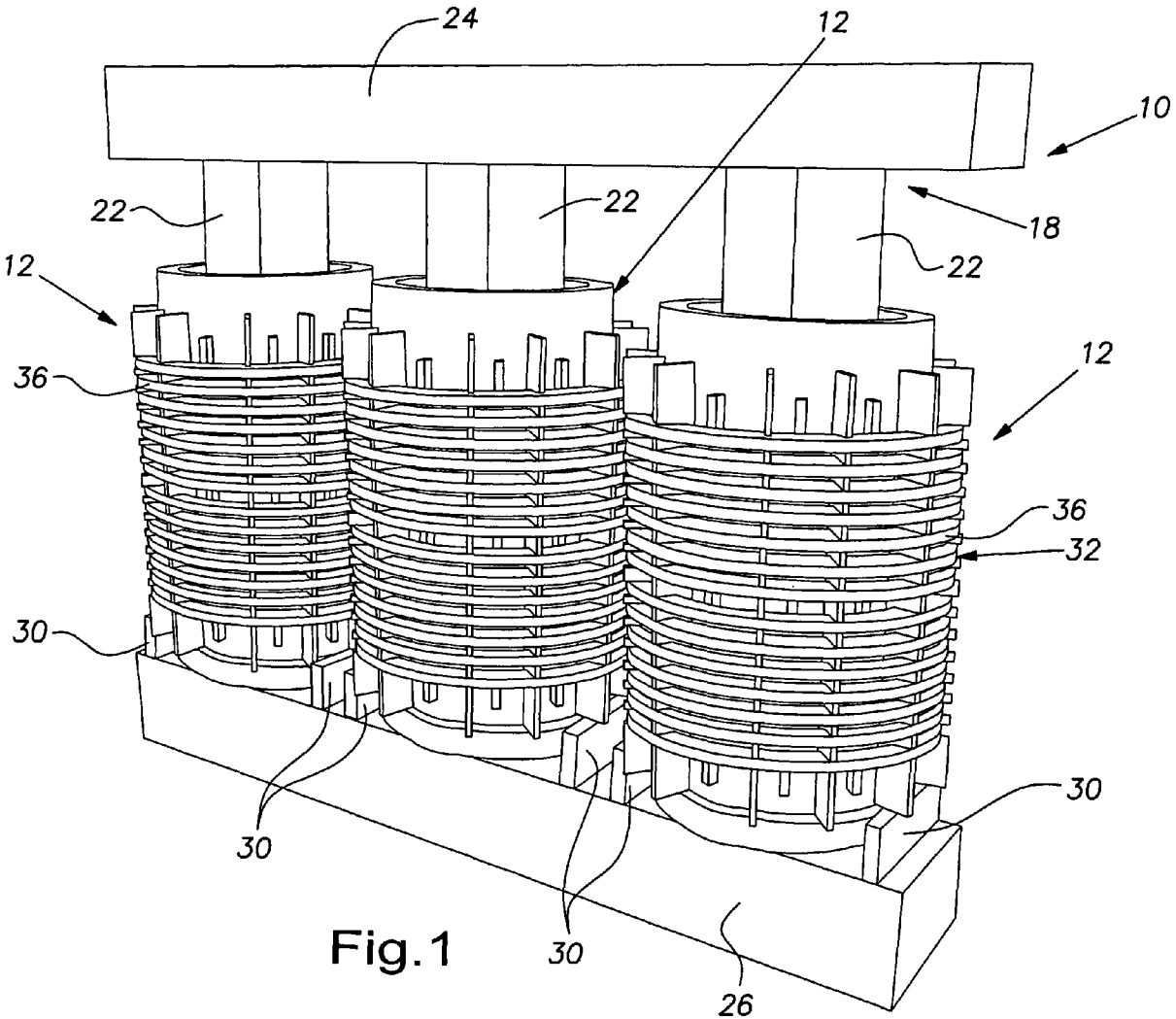
FIG. 1 is a perspective view of a portion of a transformer embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a portion of a three phase, open wound dry transformer 10 containing coils embodied in accordance with the present invention. The transformer 10 comprises three coil assemblies 12 (one for each phase) mounted to a core 18 and enclosed within a ventilated outer housing (not shown). The core 18 is comprised of ferromagnetic metal, such as grain-oriented silicone steel, and is generally rectangular in shape. The core 18 includes three spaced-apart legs 22 extending between upper and lower yokes 24, 26. A pair of support blocks 30 are mounted to the lower yoke 26 on opposing sides of each leg 22. The coil assemblies 12 are mounted to and disposed around the legs 22, respectively. Each coil assembly 12 comprises a high voltage coil 32 and a low voltage coil (not shown), each of which is cylindrical in shape. If the transformer 10 is a step-down transformer, the high voltage coil 32 is the primary coil and the low voltage coil is the secondary coil. Alternately, if the transformer 10 is a step-up transformer, the high voltage coil 32 is the secondary coil and the low voltage coil is the primary coil. In each coil assembly 12, the high voltage coil 32 and the low voltage coil may be mounted concentrically, with the low voltage coil being disposed within and radially inward from the high voltage coil 32, as shown in FIG. 1. Alternately, the high voltage coil 32 and the low voltage coil may be mounted so as to be axially separated, with the low voltage coil being mounted above or below the high voltage coil 32. The high voltage coil 32 comprises a plurality of disc windings 36 that are connected in series. As will be described in more detail below, the disc windings 36 are formed from a conductor foil or strip in a winding operation.

The transformer 10 is a distribution transformer and has a kVA rating in a range of from about 112.5 kVA to about 15,000 kVA. The voltage of the high voltage coil 32 is in a range of from about 600 V to about 35 kV and the voltage of the low voltage coil is in a range of from about 120 V to about 15 kV.

Figure 2:
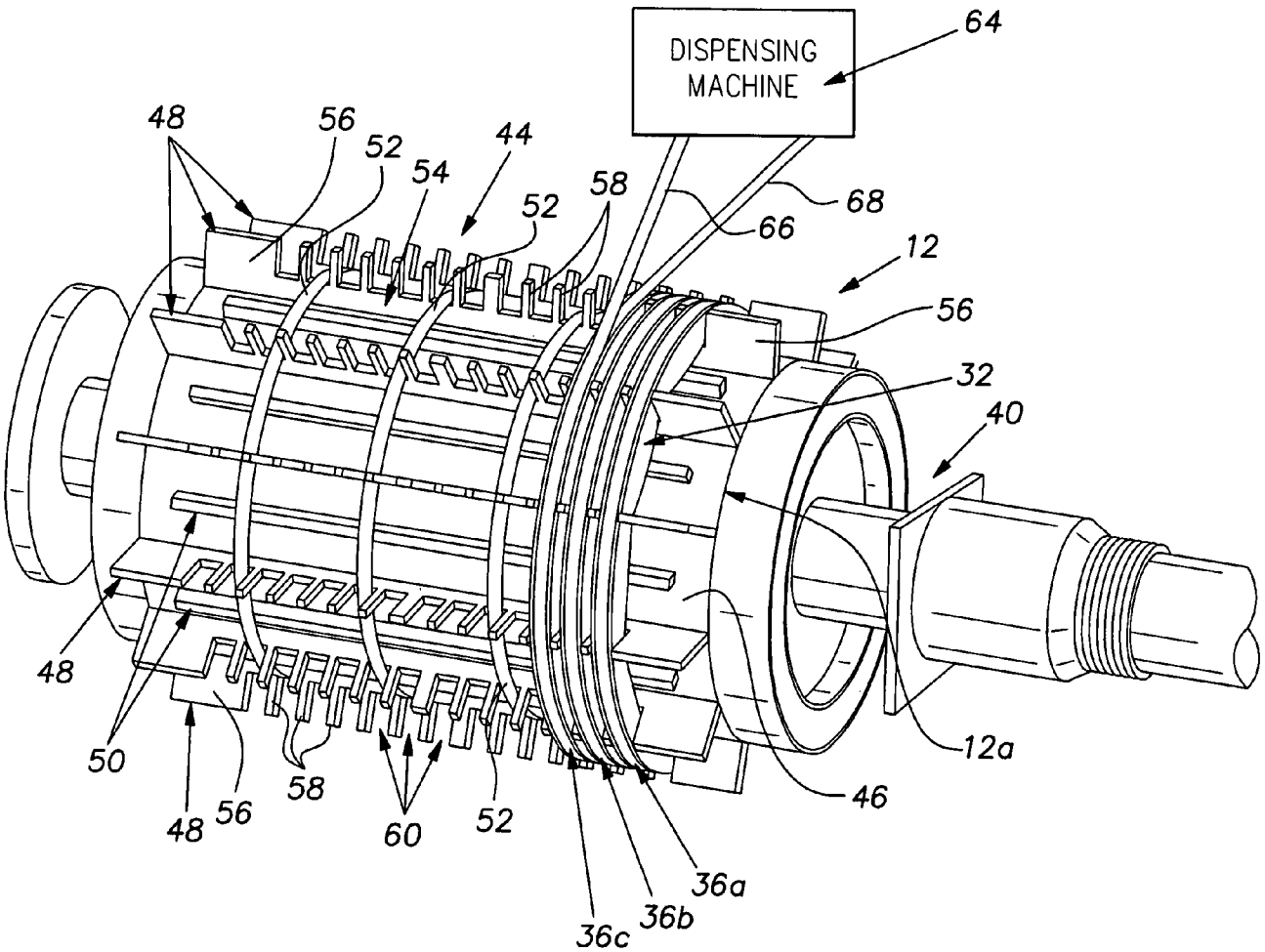
FIG. 2 shows a perspective view of a coil assembly of the transformer being formed on a winding mandrel.

Referring now to FIG. 2, one of the coil assemblies 12 is shown being formed on a winding mandrel 40. The low voltage coil is disposed radially inward from the high voltage coil 32, which is shown being wound on an insulation spool 44. The insulation spool 44 is composed of an insulating material, such as a non-conductive dielectric plastic. The insulation spool 44 includes a high/low insulation barrier 46, a plurality of guide strips 48 and a plurality of support strips 50, each of which is composed of a fiber reinforced plastic in which fibers, such as fiberglass fibers, are impregnated with a thermoset resin, such as a polyester resin, a vinyl ester resin, or an epoxy resin. The high/low insulation barrier 46 is cylindrical in shape and is sized to fit over the low voltage coil. The guide strips 48 and the support strips 50 extend longitudinally between opposing ends of the high/low insulation barrier 46 and are arranged in an alternating manner around the outer circumference of the high/low insulation barrier 46, with the guide strips 48 and the support strips 50 being substantially evenly spaced apart around the circumference of the high/low insulation barrier 46. The guide strips 48 and the support strips 50 are secured to the high/low insulation barrier 46 by tape bands 52. Alternately, the guide strips 48 and the support strips 50 may be secured by adhesive, or mechanical means to the high/low insulation barrier 46, or may be integrally molded with the high/low insulation barrier 46. Each guide strip 48 is elongated and includes a rectangular body 54 joined between enlarged rectangular end fins 56. Each body 54 has a plurality of teeth 58 that define a series of substantially evenly spaced-apart notches 60.

The winding mandrel 40, with the insulation spool 44 and the low voltage coil mounted thereon, is located adjacent to a dispensing machine 64 that is operable to simultaneously dispense a conductor strip 66 and an insulation strip 68 in an overlapping manner, with the conductor strip 66 being disposed over the insulation strip 68. The dispensing machine 64 includes a rotatable roll of the conductor strip 66 and a rotatable roll of the insulation strip 68. The conductor strip 66 is output from the dispensing machine 64 through the nip of a pair of rollers and the insulation strip 68 is output from the dispensing machine 64 through the nip of another pair of rollers. The conductor strip 66 is comprised of a conductive metal, such as copper or aluminum, and has a width to thickness ratio of greater than 20:1, more particularly from about 250:1 to about 25:1, more particularly from about 200:1 to about 50:1. In one particular embodiment, the conductor strip is between about 0.008 to about 0.02 inches thick and between about 1 and 2 inches wide, more particularly about 0.01 inches thick and about 1.5 inches wide. The insulation strip 68 may be comprised of a polyimide film, such as is sold under the trademark Nomex®; a polyamide film, such as is sold under the trademark Kapton®, or a polyester film, such as is sold under the trademark Mylar®. The insulation strip 68 is about 0.375 inches wider than the conductor strip 66. The insulation strip 68 has a width that is about the same as the width of each of the notches 60.

Initially, the winding mandrel 40 is moved in an axial direction to align a dispensing outlet of the dispensing machine 64 with a first series of notches 60 aligned around the circumference of the high/low insulation barrier 46. A first end of the conductor strip 66 may be welded to a first coil lead at this time, or may be welded to the first coil lead after the winding operation is completed. The insulation strip 68 and the conductor strip 66 are secured to the insulation spool 44 and at least partially disposed in the first series of aligned notches 60. The winding mandrel 40 is then rotated so that the insulation spool 44 rotates about its longitudinal axis in a direction away from the dispensing machine 64, i.e., in a counter-clockwise direction as viewed from a first end 12*a* of the coil assembly 12. As the insulation spool 44 rotates, the insulation strip 68 and the conductor strip 66 are pulled from the dispensing machine 64 and wrapped around the insulation spool 44 to form a first disc winding 36*a* comprising a plurality of concentric turns or layers of the conductor strip 66 interleaved with a plurality of concentric turns or layers of the insulation strip 68. The first disc winding 36*a* is radially supported on the guide strips 48 and the support strips 50 and is held in the first series of notches 60. In this manner, the first disc winding 36*a* is secured from radial and axial movement. Since the insulation strip 68 is wider than the conductor strip 66, edge portions of the insulation strip 68 form insulation areas between the turns of the conductor strip 66 and the pairs of teeth 58 forming the circumferentially-aligned notches 60.

Figure 3:
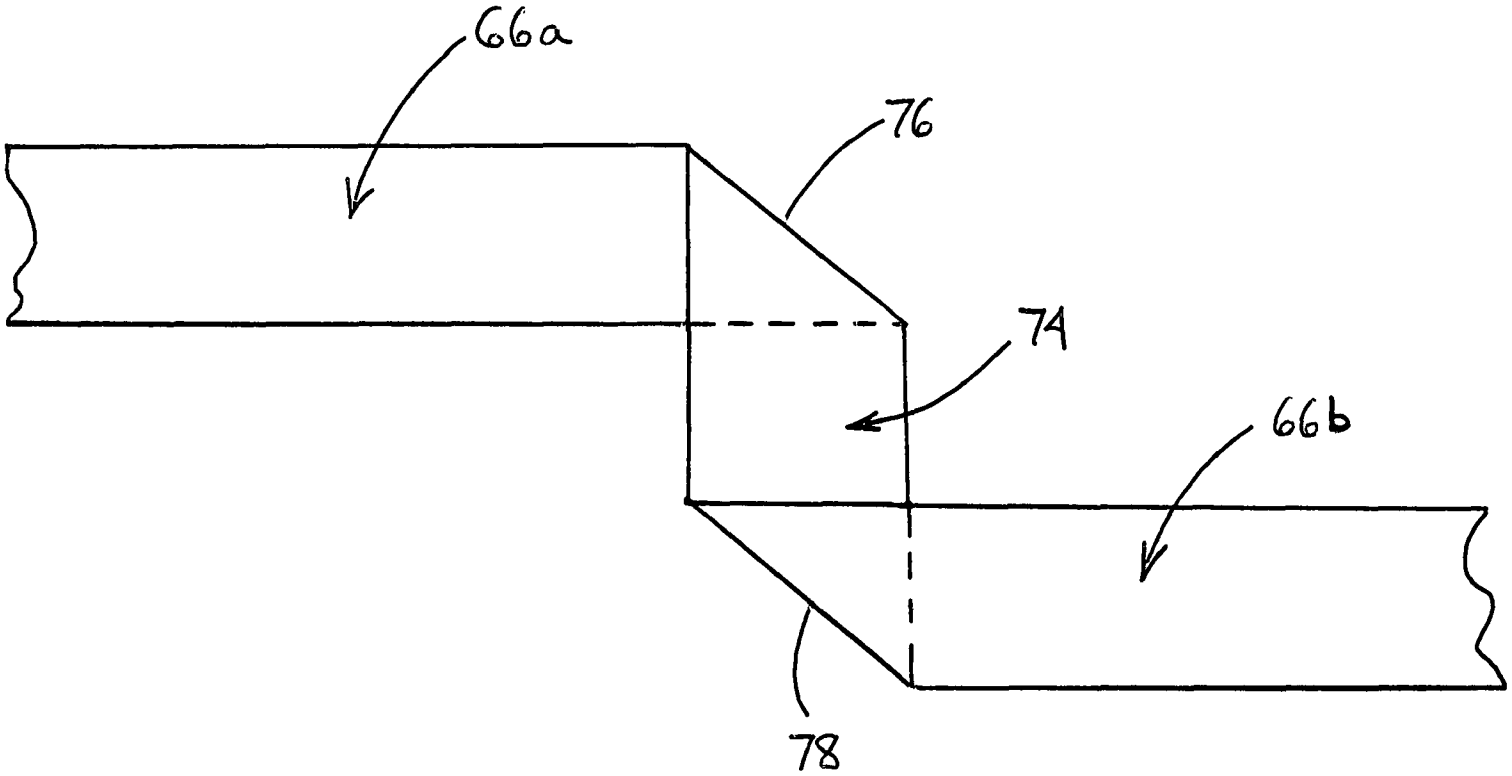
FIG. 3 shows a schematic view of an offset formed in a conductor strip used to form the coil assembly.

After the first disc winding 36*a* is formed, the rotation of the winding mandrel 40 is halted and the conductor strip 66 is prepared for the formation of a second disc winding 36*b*. The preparation of the conductor strip 66 is dependent on how the disc windings 36 will be connected to each other. If the disc windings 36 are to be connected together by welding after the winding process is completed, the conductor strip 66 is cut after the first disc winding 36*a* is formed. If, however, the disc windings 36 are connected together by being formed from the same length of conductor strip 66, an offset 74 is formed in the conductor strip 66 after the first disc winding 36*a* is formed. Referring now to FIG. 3, the offset 74 is formed between first and second portions 66*a*, 66*b* of the conductor strip 66 by making a first fold 76 at a 45° angle so that the second portion 66*b* is disposed at a 90° angle to the first portion 66*a* and then making a second fold 78 at a 45° angle so that the first and second portions 66*a*, 66*b* again extend in the same direction, but with the offset 74 in between. The distance between the first and second folds 76, 78 is selected to provide the offset 74 with a length sufficient to permit the conductor strip 66 to extend axially from the first series of aligned notches 60 to an adjacent second series of notches 60 aligned around the circumference of the high/low insulation barrier 46.

With the second portion 66*b* of the conductor strip 66 at least partially disposed in the second series of notches 60, the winding mandrel 40 is rotated again so that the insulation spool 44 rotates about its longitudinal axis in a direction away from the dispensing machine 64. As the insulation spool 44 rotates, the insulation strip 68 and the conductor strip 66 are pulled from the dispensing machine 64 and wrapped around the insulation spool 44 to form the second disc winding 36*b*, which also comprises a plurality of concentric turns or layers of the conductor strip 66 interleaved with a plurality of concentric turns or layers of the insulation strip 68.

After the second disc winding 36*b* is formed, the rotation of the winding mandrel 40 is again halted and the conductor strip 66 is again either folded or cut to prepare the conductor strip 66 for the formation of a third disc winding 36*c*. The winding mandrel 40 is again axially moved and the third disc winding 36*c* is formed in the same manner as the first and second disc windings 36*a*, 36*b*.

The above described steps are repeated until the requisite number of disc windings 36 are formed. The rotation of the winding mandrel 40 is stopped and the conductor strip 66 is cut. The coil assembly 12 may then be removed from the winding mandrel 40. If the disc windings 36 have not been formed from the same length of conductor strip 66, the disc windings 36 are then welded together. A second end of the conductor strip 66 is welded to a second coil lead and, if not already performed, the first end of the conductor strip 66 is welded to the first coil lead. Typically, the first and second coil leads extend to one end of the coil assembly 12.

Although the conductor strip 66 and the insulation strip 68 are shown and/or described as being stored separately and dispensed from the dispensing machine 64 separately, it should be appreciated that in another embodiment of the present invention, the conductor strip 66 and the insulation strip 68 may be secured together before they are dispensed from the dispensing machine 64. More specifically, the conductor strip 66 may be joined by adhesive to the insulation strip 68 to form a combined conductor/insulation strip that is stored in and dispensed from a single roll. The combined conductor/insulation strip may further be coated with a resin before the combined conductor/insulation strip is wound into the disc windings 36.

After the disc windings 36 have been formed, interconnected and welded to the first and second coil leads, the coil assembly 12 is coated with a resin, such as in a vacuum-pressure impregnation (VPI) process. The resin may be a polyester resin, an epoxy resin, a silicone resin, an acrylic resin, a polyurethane resin, an imide resin, or a mixture of any of the foregoing. In a VPI process, the coil assembly 12 is first pre-heated in an oven to remove moisture from the coil assembly 12. The coil assembly 12 is then placed in a vacuum chamber, which is evacuated to remove any remaining moisture and gases in the coil assembly 12 and to eliminate any voids between adjacent turns in the disc windings 36. The resin, in liquid form, is then applied to the coil assembly 12, while the vacuum chamber is still under a vacuum. The resin may be applied to the coil assembly 12 by submerging the coil assembly 12 in a vat filled with the resin. The vacuum is held for a short time interval, which allows the resin to impregnate the coil assembly 12, and then the vacuum is released and the pressure is increased in the vacuum chamber. This will force the resin to impregnate the remaining voids in the coil assembly 12. The coil assembly 12 is then removed from the chamber and is allowed to drip dry. The coil assembly 12 is then placed in an oven to cure the resin. Additional coatings of different resins may be applied to provide a better appearance and/or better protection from the environment.

Once the coil assemblies 12 for the transformer 10 are constructed and coated with the resin, as described above, the coil assemblies 12 are mounted to the core 18, which is placed in an upright condition, with the upper yoke 24 removed. The coil assemblies 12 are disposed over the legs 22 of the core 18, respectively, with opposing pairs of end fins 56 of each coil assembly 12 resting on a pair of support blocks 30. The upper yoke 24 is then secured in place over the legs 22.

Although the transformer 10 is shown and described as being a three phase transformer, it should be appreciated that the present invention is not limited to three phase transformers. The present invention may utilized in single phase transformers, as well.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method of manufacturing a distribution transformer comprising:

(a.) providing a core with a leg;

(b.) providing a low voltage coil;

(c.) forming a disc-wound high voltage coil comprising:

providing an insulation spool comprised of an insulating material;

providing an insulation strip;

providing a conductor strip having a width to thickness ratio of greater than about 20:1;

winding the insulation strip around the insulation spool;

winding the conductor strip around the insulation spool; and wherein the winding of the insulation strip and the winding of the conductor strip are performed so as to form a plurality of disc windings arranged in an axial direction of the high voltage coil, and wherein each of the disc windings comprises alternating concentric layers of the conductor strip and the insulating strip;

(d.) mounting the low voltage coil to the core; and (e.) mounting the high voltage coil to the core such that the leg extends through the insulation spool.

2. The method of claim 1, wherein the step of providing the insulation spool is performed such that the insulation spool is comprised of fiber-reinforced plastic.

3. The method of claim 2, wherein the step of providing the insulation spool is performed such that the insulation spool defines a first series of aligned notches and a second series of aligned notches, and wherein the step of winding the insulation strip and the conductor strip is performed such that a first disc winding is disposed in the first series of aligned notches and a second disc winding is disposed in the second series of aligned notches.

4. The method of claim 3, wherein the step of providing the insulation spool is performed such that the insulation spool comprises:

a cylindrical insulation barrier;

a plurality of spaced-apart guide strips disposed around the circumference of the insulation barrier, each of the guide strips comprising a plurality of teeth defining first and second notches; and wherein the first series of aligned notches comprise the first notches of the guide strips, and the second series of aligned notches comprise the second notches.

5. The method of claim 4, wherein the step of providing the insulation spool comprises:

providing the guide strips separate from the insulation barrier; and securing the guide strips to the insulation barrier.

6. The method of claim 4, wherein the insulation strip has a width greater than a width of the conductor strip such that in each of the disc windings, insulation areas comprised of the insulation strip are formed between each layer of the conductor strip and the teeth of the insulation spool.

7. The method of claim 4, wherein the forming of the disc-wound high voltage coil further comprises coating the disc windings and the insulation spool with a liquid resin while the disc windings and the insulation spool are placed under a vacuum.

8. The method of claim 3, wherein the step of winding the conductor strip comprises performing first and second windings of the conductor strip around the insulation spool, and wherein the step of winding the insulation strip comprises performing first and second windings of the insulation strip around the insulation spool, wherein the first windings of the conductor strip and the insulation strip form the first disc winding, and the second windings of the conductor strip and the insulation strip form the second disc winding, and wherein the forming of the disc-wound coil further comprises cutting or folding the conductor strip between the first and second windings of the conductor strip.

9. The method of claim 8, wherein between the first and second windings of the conductor strip, the conductor strip is folded to form an offset.

10. The method of claim 8, wherein between the first and second windings of the conductor strip, the conductor strip is cut, and wherein the forming of the disc-wound coil further comprises reconnecting a portion of the conductor strip forming the first disc winding with a portion of the conductor strip forming the second disc winding.

11. The method of claim 1, wherein the step of winding the insulation strip and the step of winding the conductor strip are performed simultaneously.

12. The method of claim 11, wherein the step of forming the disc-wound high voltage coil further comprises unwinding the insulation strip from a roll of the insulation strip, and unwinding the conductor strip from a roll of the conductor strip.

13. The method of claim 12, wherein the steps of winding the insulation strip and the conductor strip around the insulation spool and the steps of unwinding the insulation strip and the conductor strip from the rolls of the insulation strip and the conductor strip respectively, comprises rotating the insulation spool in a direction away from the rolls of the insulation strip and the conductor strip.

14. The method of claim 1, wherein the conductor strip is composed of copper and has a width to thickness ratio of from about 250:1 to about 25:1.

15. The method of claim 1, wherein the forming of the high voltage coil is performed such that the disc windings are connected in series.

16. The method of claim 1, wherein the insulation strip is wider than the conductor strip.

* * * * *